US008337633B2

(12) United States Patent
Stine

(10) Patent No.: US 8,337,633 B2
(45) Date of Patent: Dec. 25, 2012

(54) WATER-POWERED HAND-WASHING METHOD

(75) Inventor: Patrick Stine, Whiting, VT (US)

(73) Assignee: Clean Hands, Inc., Whiting, VT (US)

( * ) Notice: Subject to any disclaimer, the term of this patent is extended or adjusted under 35 U.S.C. 154(b) by 0 days.

(21) Appl. No.: 13/223,459

(22) Filed: Sep. 1, 2011

(65) Prior Publication Data

US 2011/0315159 A1 Dec. 29, 2011

Related U.S. Application Data

(62) Division of application No. 12/371,673, filed on Feb. 16, 2009, now Pat. No. 8,028,710.

(60) Provisional application No. 61/056,546, filed on May 28, 2008.

(51) Int. Cl.
*B08B 3/00* (2006.01)
*B08B 7/04* (2006.01)

(52) U.S. Cl. ..... 134/34; 134/18

(58) Field of Classification Search ..... 134/34, 134/42, 18, 56 R, 104.2, 182, 198, 22.12, 134/22.18, 24, 25.1, 68, 200, 201; 4/619, 4/678

See application file for complete search history.

(56) References Cited

U.S. PATENT DOCUMENTS 2,747,588 A * 5/1956 Bonner ..... 134/93
3,982,965 A 9/1976 Spotz
4,020,856 A 5/1977 Masterson
4,119,439 A 10/1978 Boucher
4,137,929 A * 2/1979 Grossman ..... 134/182
4,289,152 A 9/1981 Fuhre
4,635,656 A 1/1987 Daniel
4,742,836 A 5/1988 Buehler
5,193,563 A 3/1993 Melech
5,522,411 A * 6/1996 Johnson ..... 134/95.2

(Continued)

FOREIGN PATENT DOCUMENTS

EP 0389884 10/1990

(Continued)

OTHER PUBLICATIONS

Restriction Requirement dated Nov. 22, 2010 in related U.S. Appl. No. 12/371,673.

(Continued)

*Primary Examiner* — Michael Kornakov
*Assistant Examiner* — Arlyn I Rivera-Cordero
(74) *Attorney, Agent, or Firm* — Occhiuti Rohlicek & Tsao LLP

(57) ABSTRACT

A hand-washing system for washing fingernail beds and cuticular regions of human fingers and thumbs (collectively "digits"). The hand-washing system includes a work enclosure for containing ones of the digits and a high-velocity, high-flow water spray during a washing operation. The work enclosure defines an interior space, part of which defines an energy-dissipation region that, during use, provides a water reservoir for dissipating energy in the high-velocity, high flow water spray. The work enclosure includes a high-energy spray nozzle and a digit portal sized to receive the four fingers of one hand simultaneously in closed-fingered, upwardly-curled configuration. A mixing valve may be provided to allow a user to adjust the temperature of the water during washing. A quick-disconnect fluid-coupling assembly may also be provided and be used to quickly select between work enclosures of differing size.

12 Claims, 3 Drawing Sheets

U.S. PATENT DOCUMENTS

| | | | |
|---|---|---|---|
| 5,713,378 | A | 2/1998 | Smith |
| 5,755,240 | A | 5/1998 | Schonborn |
| 5,823,447 | A | 10/1998 | Maybach |
| 6,176,941 | B1 | 1/2001 | Jewett et al. |
| 6,431,189 | B1 | 8/2002 | Deibert |
| 2009/0293913 | A1 | 12/2009 | Stine |
| 2009/0299787 | A1 | 12/2009 | Barnhill |

FOREIGN PATENT DOCUMENTS

| | | | |
|---|---|---|---|
| EP | 0389884 | A1 * | 10/1990 |
| FR | 2758445 | | 7/1998 |

OTHER PUBLICATIONS

Response to Restriction Requirement dated Nov. 24, 2010 in related U.S. Appl. No. 12/371,673.

First Office Action dated Dec. 23, 2010 in related U.S. Appl. No. 12/371,673.

Meritech, 500EZ Product Information Sheet, wwww.meritech.com/products/500/index.php.

Response to Office Action dated Apr. 25, 2011 in related U.S. Appl. No. 12/371,673.

*Ex Parte Quayle* Action dated Jun. 1, 2011 in related U.S. Appl. No. 12/371,673.

Response to *Ex Parte Quayle* Action dated Jun. 27, 2011 in related U.S. Appl. No. 12/371,673.

Notice of Allowance dated Jul. 12, 2011 in related U.S. Appl. No. 12/371,673.

* cited by examiner

WATER-POWERED HAND-WASHING METHOD

RELATED APPLICATION DATA

This application is a divisional of application U.S. application Ser. No. 12/371,673, filed Feb. 16, 2009, and titled "Water-Powered Hand-Washing System and Method," which is incorporated by reference herein in its entirety. This application also claims the benefit of priority of U.S. Provisional Patent Application Ser. No. 61/056,546, filed on May 28, 2008, and titled "Water-Powered Handwasher And Hand-Washing Method," which is incorporated by reference herein in its entirety.

FIELD OF THE INVENTION

The present invention generally relates to the field of personal hygiene. In particular, the present invention is directed to a method of hand-washing using a hand-washing system.

BACKGROUND

All human surfaces harbor bacteria; some have favorite places. Certain forms of non-pathogenic streptococci limit their homesites to the first millimeter of oral mucosa at the gumline. Common forms of *staphylococcus* are found in a third of asymptomatic noses. By virtue of their role in touching public items, procuring food, picking noses, satisfying itches and handling-the-paper chores, the thumb and first two fingers probably provide the greatest sample and volume of bacteria from the daily environment. If those digits carry pathogenic *E. coli, Salmonella* or methicillin-resistant *Staph aureus* (MRSA), you may have a major health problem. If they invite more ordinary bacteria and viruses to the kitchen and dinner table, you may just get sick for a few days.

One way to stay healthy is to reduce the bacterial count on the hands. It is impossible, even with a ten-minute surgical scrub, to eliminate all of them. A unique problem exists in the nail beds, where accumulated oil and dirt may provide a refuge for bacteria and be hard to displace. Soaps and detergents act in two ways. Their main role is to cut the grease and soften the buildup under the nails and in the cuticles. They may also directly injure the cell membranes of bacteria, affecting their mobility or even killing them. Soaps and detergents require sufficient time and concentration at the work site to be effective.

Commonly used bactericidal chemicals intended for use on skin, for example, antiseptics, include iodine and mercury compounds, phenol, alcohol, benzalkonium chloride, mineral spirits, propylene glycol, chlorhexidine and hexachlorophine. Their role in routine hand cleaning is limited by their potential to irritate skin.

A number of devices have been developed over the years for assisting in the cleaning of fingertips, particularly the hard-to-clean nail beds and cuticles. However, each of these devices has at least one drawback, ranging from low cleaning efficiency to difficulty in cleaning the device between uses, among others.

SUMMARY OF THE DISCLOSURE

In one implementation, the present disclosure is directed to a method of washing all five digits of a human hand. Each digit having a nail bed that includes providing a work enclosure having an opening, an interior space, a base portion with a bottom and a spray nozzle positioned opposite the bottom for providing a spray of water to the interior space; providing water to the spray nozzle so that the inlet water pressure of the spray nozzle is at least 10 pounds per square inch, the outlet flow rate is at least 0.7 gallons per minute and the nozzle exit velocity of the spray of water delivered from the spray nozzle is at least 35 feet per second; inserting through the opening and into the interior space in the work enclosure the four three-phalanx digits; delivering the spray of water while positioning the four three-phalanx digits so that the spray of water penetrates into the nail beds of the digits for a first period of time; removing the four three-phalanx digits from the interior space; inserting the opposing thumb into the interior space so that the tip of the opposing thumb is pointing substantially toward the spray nozzle; and delivering the spray of water while positioning the thumb for a period of time so that the spray of water penetrates into the nail beds of the thumb for a second period of time.

In another implementation, the present disclosure is directed to a method of washing digits of a human hand. Each digit having a nail bed that includes providing a work enclosure having an opening, an interior space, and a spray nozzle positioned for providing a spray of water along a path to the interior space; providing water to the spray nozzle so that the spray of water is delivered from the spray nozzle with a V/Q ratio of at least about 20 FPS/GPM; inserting through the opening and into the interior space in the work enclosure at least one of the four three-phalanx digits so that the nail bed is positioned in the path of the spray of water such that the spray of water extends into the nail beds of the digits for at least 20 seconds; removing the at least one of the four three-phalanx digits from the interior space; inserting the opposing thumb into the interior space so that its nail bed is positioned in the path of the spray of water such that the spray of water extends into the nail bed for at least 20 seconds.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

The present disclosure is directed to water-powered hand-washing systems and components therefor that provides significant advantages over conventional water-based hand-washing devices known to the present inventor. Important among these advantages is the fact that a hand-washing system of the present disclosure provides excellent cleaning effectiveness, especially in the ability to dislodge and remove large fractions of bacteria and other foreign matter from fingernail beds and cuticular regions of fingers and thumbs with relatively little effort on the user's part, as compared to conventional cleaning methods, such as scrubbing with a nail brush. Another important advantage is that this cleaning effectiveness can be achieved at conventional domestic water supply pressures, for example, from about 20 pounds per square inch (PSI) to about 50 PSI. Other important advantages and improvements over conventional hand-washing devices, systems and methods will become apparent upon reading the following disclosure.

Figure 1:
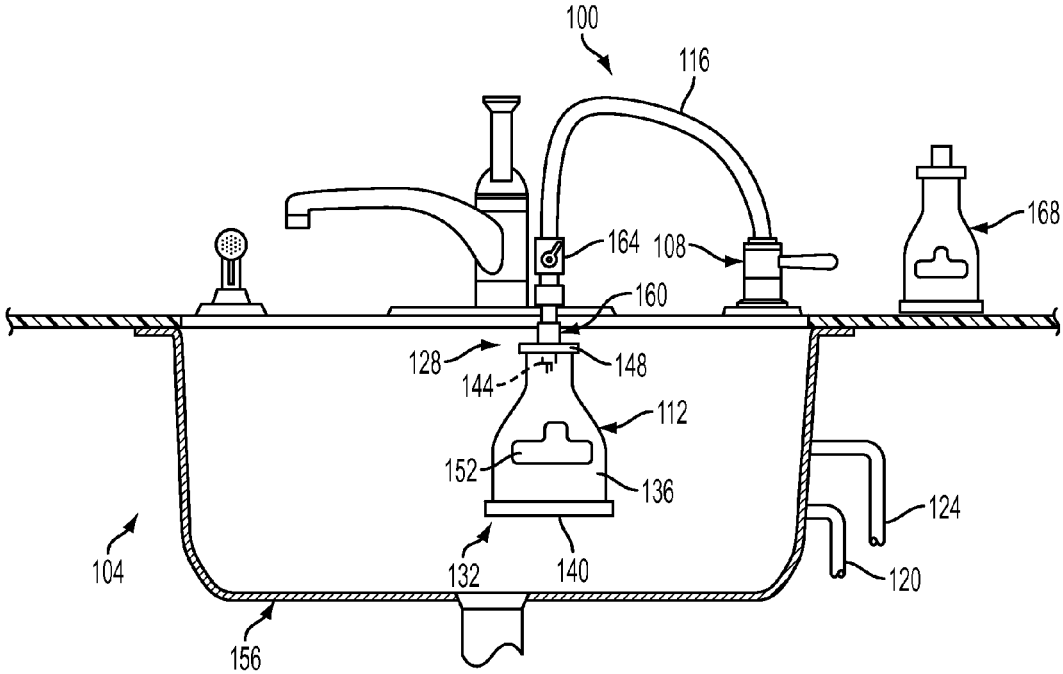
FIG. 1 is a partial cross-sectional view/partial elevational view of a water-powered hand-washing system installed in a household kitchen sink setting.

Turning now to the drawings, FIG. 1 illustrates an example of a water-powered hand-washing system 100 made in accordance with broad concepts disclosed herein. In this example, hand-washing system 100 is shown in a home-kitchen environment wherein it is integrated into a kitchen-sink installation 104. As such, hand-washing system 100 is readily available for use by virtually all members of the corresponding household, except perhaps for the very youngest of children. Installing a hand-washing system of the present disclosure in a central location, such as in a kitchen, is desirable because in some embodiments an important aspect of the system is that it be used routinely by all members of the household throughout the day, especially following any activity, such as gardening and preparing meals from raw meat, in which fingernail beds and cuticular regions become particularly dirty and/or are exposed to bacteria-laden/bacteria-promoting matter and especially before engaging in an activity, such as eating and dental flossing, where any bacteria and/or other undesirable matter present in fingernail beds and cuticular regions could easily enter a human body.

As those skilled in the art will readily appreciate, a home-kitchen environment, such as installation 104 of FIG. 1, is only one example of a location suitable for containing a water-powered hand-washing system made in accordance with one or more of the broad concepts of the present disclosure. Other examples of environments where installation of a system of the present disclosure would be beneficial include, but are not limited to, commercial kitchen environments to assist in the cleaning of hands of cooks and other food handlers so as to inhibit the spread of bacteria and other undesirable matter among food items and work areas, and health care environments to assist surgeons, physician's assistants and nurses in preparing for surgery or providing hands-on patient care so as to reduce the likelihood of contaminating the patient and risking infection. Indeed, and as described below, some of the broad concepts of the present disclosure are directed to features that will contribute to the efficacy of such systems not only in home and kitchen use, but in use in surgical settings where the cleanliness requirements are much more critical. Some or all of these features are lacking in various ones of conventional finger/thumb/hand cleaning assistance devices of which the present inventor is aware.

With continuing reference to FIG. 1, primary components of hand-washing system 100 include a mixing/flow valve 108, a work enclosure 112 and a flexible conduit 116 that fluidly connects the work enclosure to the mixing valve. Mixing/flow valve 108 is fluidly connected to each of a cold water supply line 120 and a hot water supply line 124, which may be any conventional domestic water supply lines, such as half-inch household lines that typically deliver a maximum of 1.8 gallons per minute (GPM) (California plumbing regulations) to 2.5 GPM (the rest of the U.S.) within a range of 20 PSI to 60 PSI. Typically, the hydrostatic pressure available in household water lines ranges from 20 PSI to 50 PSI, with an average range of about 35 PSI to 45 PSI in most municipal lines and 35 PSI to 40 PSI in most well or domestic, pump-driven lines.

When in use, mixing/flow valve 108 mixes cold and hot water from, respectively, cold and hot water supply lines 120, 124 so as to provide a desired/suitable temperature to the mixed output water, which flexible conduit 116 then provides to work enclosure 112. A thermostatic cartridge with mixing/flow valve 108 can protect users from scalding by limiting the maximum hot water temperature provided. Mixing/flow valve 108 also allows a user to adjust the flow of water provided to work enclosure 112 so as to optimize the cleaning conditions and user comfort of the spray within the enclosure. Mixing/flow valve 108 may be any suitable mixing valve. An example of a suitable mixing valve is the mixing valve portion of the Kohler® HIRise™ sidespray unit model K-7344-4, available from Kohler Company, Kohler, Wis. Of course, that unit would have to be modified to receive flexible conduit 116 rather than the sidespray assembly accompanying the valve. In a particular example, the modified unit includes flexible conduit 116 in a length of 28 inches measured from the base at the countertop to the shutoff valve (164). Of course, any one of many other mixing valves could be used. A constraint on the choice of mixing valves for use as mixing valve 108 is that the selected valve must be able to provide the water pressures and flow rates described below that are needed to provide hand-washing system 100 with it cleaning effectiveness.

As will become apparent from reading the following description, during use work enclosure 112 is designed to be oriented as shown in FIG. 1. As such, during use work enclosure 112 has an upper end 128 and a lower end 132. Primary components of work enclosure 112 include a sidewall 136, a bottom closure 140 and a spray nozzle 144. In the example shown, the opening formed by sidewall 136 at upper end 128 of work enclosure 112 is larger than the diameter of spray nozzle 144. Consequently, this example includes a top closure 148 to close the region between nozzle 144 and sidewall 136 so as to prevent backspray from exiting upper end 128 of work enclosure 112. In other embodiments, the upper end of the sidewall and corresponding spray nozzle may be designed so that the interface between the nozzle and sidewall obviates the need for any additional closure at the upper end of the work enclosure. Sidewall 136 includes a "digit" portal 152 ("digit" referring to the digits of a human hand, i.e., the fingers and thumb) that allows a user to insert one thumb or four fingers into the interior of work enclosure 112 in a proper manner (see below). Further details of work enclosure 112 are described below in connection with FIGS. 2-4.

Figure 2:
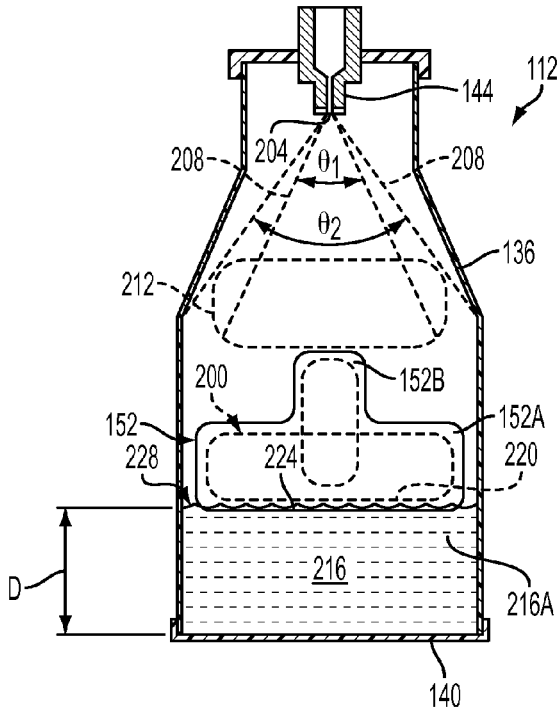
FIG. 2 is an enlarged vertical cross-sectional view of the work enclosure of the water-powered hand-washing system of FIG. 1.

Referring now to FIG. 2, work enclosure 112 is configured to receive the proximal, intermediate and distal phalanges of all four fingers simultaneously so that these four fingers can be cleaned substantially simultaneously with one another. To facilitate this simultaneity, digit portal 152 includes a laterally elongate finger-receiving slot 152A sized to accommodate these four fingers up to and including their proximate phalanges when these fingers are in loose contact with one another and inserted into work enclosure 112 in an upwardly curled manner as illustrated by finger 300 in FIG. 3. In this work position, the intermediate and distal phalanges of these four fingers are wholly contained within work enclosure 112. It is noted that in alternative embodiments in which all three phalanges of all four fingers may be inserted into the work enclosure at once, the work enclosure may be configured so that the user inserts his hand more than or less than shown in FIG. 3. For example, in some other embodiments the work enclosure may be configured for the user to insert their hand up to or past the metacarpophalangeal joints of those four fingers. Some other embodiments may be configured for the user to insert those four fingers only to their intermediate phalanges or their proximal interphalangeal joints.

Figure 3:
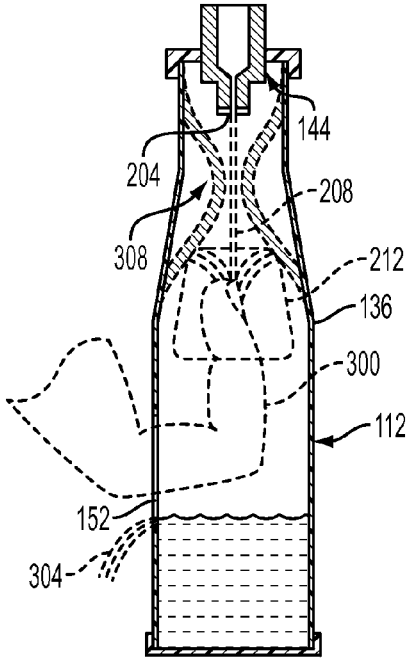
FIG. 3 is an enlarged vertical cross-sectional view of the work enclosure of FIG. 1 illustrating an orientation of a finger inserted into the work enclosure for cleaning.

Referring back to FIG. 2, dashed line 200 indicates the periphery of the approximate space occupied by the portion of the hand (here, the proximal phalangeal portion) that extends through digit portal 152 when an adult hand of 95-percentile breadth (e.g., 3.9 in. (9.8 cm) based on U.S. statistics) is properly positioned relative to work enclosure 112. In the example of FIGS. 1-3, when the four three-phalanx fingers of one of the user's hands are inserted in an upwardly curled manner as illustrated in FIG. 3, the user may be holding work enclosure 112 with the opposite hand by, for example, grasping the necked-down upper portion of the enclosure with the thumb and index and middle fingers. In alternative embodiments, the work enclosure could be secured to a fixture (not shown) or freestanding.

Spray nozzle 144 is either designed or selected to provide high volumetric flow rates and high outlet velocities across a range of delivery pressures. In the example shown, spray nozzle 144 has an outlet orifice 204 configured to provide a fan-shaped spray pattern 208, which is an effective shape because of the generally linear arrangement of the tips of the four three-phalanx fingers when they are in their work position as described above. The magnitude of included-angle θ (theta) may be selected based on the distance of the fingertip-receiving region (denoted by its outline 212) within work enclosure 112 from spray nozzle 144 (here, about 1.5 inches to 2 inches). The four fingers, once inserted, are moved side-to-side (here, about 0.75 inches to about 1 inch) to expose all surfaces to the full force of the high-velocity, high-flow-rate stream from spray nozzle 144. Based on the configuration of work enclosure 112 and working position of the hand within the enclosure, an acceptable included angle θ would generally fall in a range of about 30° ($\theta_1$) to about 60° ($\theta_2$). In other embodiments having configurations different from the configuration of work enclosure 112, the included angle of the corresponding spray patterns may be outside the range shown.

As seen in FIG. 3, in the direction perpendicular to the fan shape, spray pattern 208 remains fairly concentrated. That is, spray pattern 208 has very little spread as the spray moves away from outlet orifice 204. This narrowness allows the force of the spray to be as concentrated as possible in the fingertip-receiving region 212 where the user's digit tips will be located during cleaning. With spray pattern 208 remaining fixed and being relatively narrow in a plane perpendicular to the planes in which the fingers are positioned while present inside work enclosure 112 (i.e., the vertical plane into and out of the page containing FIG. 3), it can be appreciated that for the user to achieve the best cleaning results the user should slowly flex and extend the fingers and move them side-to-side (again, about 0.75 inches to about 1 inch in this example) to expose palmar surfaces, fingernail beds, cuticular regions and lateral surfaces to the spray for an effective amount of time (such as 30 seconds to 40 seconds or more).

Figure 4:
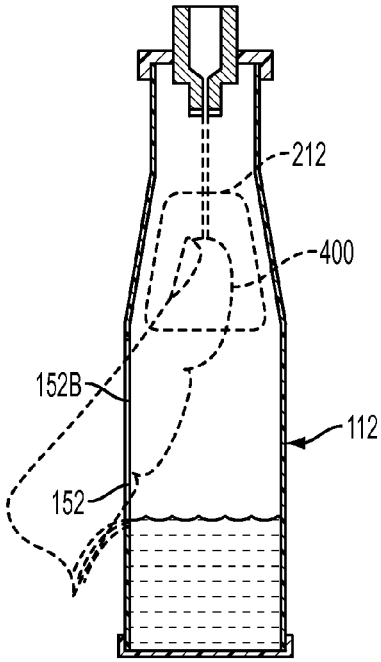
FIG. 4 is an enlarged vertical cross-sectional view of the work enclosure of FIG. 1 illustrating an orientation of a thumb inserted into the work enclosure for cleaning.

Referring again to FIG. 2, and also to FIG. 4, this example of digit portal 152 further includes a thumb notch 152B designed to accommodate the user's thumb 400 (FIG. 4) during washing. FIG. 4 illustrates one way that the user can insert thumb 400 into work enclosure 112, i.e., with the thumbnail generally facing the "front" of the work enclosure. Alternatively, the thumb may be inserted with the thumbnail facing the "back" of work enclosure 112. In either position the thumb can be gently flexed or extended to provide thorough exposure of the palmar surface, fingernail bed, cuticular surface and lateral surfaces to the spray for an effective amount of time (e.g., 20 seconds total or more). The choice of thumb orientation will generally depend on factors such as the location/locatability of work enclosure 112 relative to the user during washing and whether or not the user is holding the work enclosure with the opposite hand during washing.

With thumb 400 being generally more limited in terms of range-of-motion and positionability relative to the three-phalanx fingers, thumb notch 152B allows the user to position the tip of the thumb in fingertip-receiving region 212 where the tips of the three-phalanx fingers are located during washing. When thumb 400 is inserted into work enclosure 212 as shown in FIG. 4, the particular configuration of this work enclosure has roughly the entire distal phalanx of the thumb located within the enclosure. In other embodiments, it may be necessary to design the work enclosure so that some or most of the proximal phalanx of thumb 400 is also located within the enclosure. When thumb 400 of the user's one hand is inserted into work enclosure 112 as shown in FIG. 4, the user may be holding the work enclosure with the other hand, for example, as described above relative to the washing of the four three-phalanx fingers. Alternatively, work enclosure 112 may be secure to a fixture or free-standing.

As mentioned above, a hallmark of a water-powered hand-washing system of the present disclosure is the exposing of finger tips, especially the palmar surfaces, fingernail beds and cuticular regions, to high-impact-energy, high-flow-rate water spray. To this end, in a particular example suited for the particular configuration of working enclosure 112 shown in FIGS. 2-4 (with the various figures being largely in scale relative to finger 300 and thumb 400 of FIGS. 3 and 4, respectively), spray nozzle 144 is standard fan nozzle model ¼"NF1530 (30° fan) available from BETE Fog Nozzle, Inc., Greenfield, Mass. The ¼"NF1530 nozzle has the performance characteristics appearing in the following Table.

TABLE

Performance Characteristics of BETE 30° Fan Nozzle Model ¼" NF1530

| Inlet Pressure (P) (PSI) | Outlet Flow (Q) (GPM) | Exit Velocity (V) (ft/s (FPS)) | V/Q ((FPS)/(GPM)) |
|---|---|---|---|
| 10 | 0.75 | 34.7 | 46.3 |
| 20 | 1.06 | 49.0 | 46.2 |
| 30 | 1.30 | 60.1 | 46.2 |
| 40 | 1.50 | 69.4 | 46.3 |
| 50 | 1.68 | 77.5 | 46.1 |
| 60 | 1.84 | 85.2 | 46.3 |

The performance characteristics of the BETE® ¼"NF1530 spray nozzle listed in the preceding Table provide hand-washing system 100 (FIG. 1) with very good cleaning performance. Observations of test users have revealed that, with the BETE® ¼"NF1530 nozzle, its spray at an inlet pressure of about 20 PSI is well-tolerated by children. Adult test users have found its spray at about 35 PSI to about 50 PSI to be comfortable and invigorating. In this connection, it is noted that mixing/flow control valve 108 allows users to adjust the spray output by spray nozzle 144 to a comfortable, yet effective level, generally between about 10 PSI (0.75 GPM for the BETE® ¼"NF1530 nozzle) to about 58 PSI (1.8 GPM for the BETE® ¼"NF1530 spray nozzle (again, 1.8 GPM is the current maximum flow rate under California standards)). Operation at pressures higher than 58 PSI with the BETE® ¼"NF1530 spray nozzle is possible depending on code regulations (such as the 2.5 GPM maximum in U.S.

states other than California) and whether a particular user can tolerate the resulting higher spray velocities.

As mentioned above, the cleaning effectiveness of hand-washing system 100 is due in large part to dilution and debridement accomplished by subjecting the target digit(s) to both high water flow (dilution) and high-impact water velocity (debridement). Regarding water flow rates, it is desired that the flow rate be at least about 0.75 GPM and more preferably at least about 1.3 GPM, with values up to 1.8 GPM (California standard) or 2.5 GPM (non-California states' standard) typically being more desirable as long as the resulting higher velocities are tolerable by a particular user. Regarding nozzle exit velocity, which correlates with impact force of the spray upon the digit(s) placed in fingertip-receiving region 212 (FIGS. 2-4), it is desirable that the exit velocity be at least about 40 feet per second (FPS) during cleaning, regardless of outlet flow rate or inlet pressure. For adults having the digit closest to the exit orifice of nozzle 144 about 1.5 inches to 2 inches from exit orifice 204, the exit velocity is more preferably at least about 60 FPS.

A convenient way to express the relationship between exit velocity (V) and outlet flow (Q) for any nozzle is to calculate the V/Q ratio. As seen from the Table above, for the BETE® ¼"NF1530 spray nozzle the V/Q ratio is largely constant, here about 46.3 FPS/GPM, over the range of inlet pressures appearing in the Table. It is recognized that water spray nozzles suitable for use as nozzle 144 other than the BETE® ¼"NF1530 nozzle will have performance characteristics different from the performance characteristics of the ¼"NF1530 nozzle presented in the Table above. For example, not only can the V/Q ratio be different, but the outlet flow rates Q and exit velocities at particular pressures can be different, too. For example, a suitable alternative nozzle may provide a flow rate of 1.6 GPM at 30 PSI and have a corresponding outlet velocity of 70 FPS (here, V/Q would be about 43.8 FPS/GPM. Regardless of the nozzle used, it is beneficial for the V/Q ratio, when V is expressed in FPS and Q is expressed in GPM, to be at least about 20 FPS/GPM and more preferably at least about 30 FPS/GPM.

When hand-washing system 100 (FIG. 1) is operating within the intended ranges of flow rates and velocities, the water output of nozzle 144 can be equated to output of a conventional garden-hose nozzle outputting 1.8 GPM in a fairly tightly focused pattern at a line-pressure of 45 PSI. As one can imagine, the output rate and forcefulness of spray nozzle 144 is quite substantial, especially for a device intended for use inside homes, in commercial kitchens and in surgical scrub areas, among other places. In this connection and referring again to FIG. 2, work enclosure 112 includes an energy-dissipation region 216 that, during use, defines an energy-dissipating reservoir of water 216A for rapidly dissipating energy in the high-velocity water spray from nozzle 144 during use, both when one or more digits are properly inserted into the work enclosure and being washed and when the nozzle is spraying water without any digits present within the work enclosure. The latter situation can occur if the nozzle is still operating but the user does not have any digits inside enclosure 112, such as just before or just after a washing operation.

As seen in FIG. 2, dashed line 220 indicates that when a hand is properly engaged with work enclosure 112, a gap exists between the lower edge 224 of sidewall 136 and the hand-occupied region of digit portal 152. FIG. 3 illustrates that when hand-cleaning system 100 is operating, this configuration allows reduced-energy water 304 to fairly gently exit work enclosure 112 and fall to a suitable location, such as a sink, for example, sink 156 of FIG. 1, without interfering with the insertion or removal of any of the digits during a cleaning operation. It is noted that in alternative embodiments, bottom closure 140 and/or sidewall 136 near lower end 132 can each be provided with one or more apertures to partially or fully handle the outflow of water from within work enclosure 112 during use. That said, for the sake of easily maintaining the cleanness of work enclosure 112, the fewer apertures, especially relatively small apertures having reentrant corners/small radii, the better, since contaminants tend to build up in such areas, even with moderate cleaning.

A large part of the energy-dissipation capability of energy-dissipation region 216 is due to the depth D of the pool 228 of water that eventually collects in the energy-dissipation region. Depth D should be great enough that the force of the spray striking pool 228 at full spray without any digits present within enclosure 112 does not part water 228 all the way to bottom closure 140. For the BETE® 30° ¼"NF1530 nozzle described above, an adequate depth D that provides ample energy dissipation is about 1.5 inches. Somewhat lesser depths could likely be tolerated, as could greater depths. If additional apertures are provided to work enclosure 112 as mentioned above, care should be taken to avoid placing them in the direct path of spray pattern 208 if they are un-baffled because the spray will tend to exit the work enclosure forcefully through such apertures until enough depth has built up in pool 228.

FIG. 3 illustrates two configurations of sidewall 136 near spray nozzle 144. The first configuration (shown in solid lines) is a straightforward configuration that includes a gentle tapering of sidewall 136 from its widest region (relative to the view of FIG. 3) near digit portal 152 to its narrowest region near nozzle 144. The second configuration (shown in dashed lines) includes a "pinched" region 308 near nozzle 144 that inhibits backsplashing from the impact of the spray issued by the nozzle upon one or more digits present in fingertip-receiving region 212. By inhibiting such backsplash, contamination of nozzle 144 and regions immediately surrounding the nozzle can be reduced.

Further regarding the cleanness of work enclosure 112, several features of this enclosure provide it with excellent cleanability. In surgical and other patient-care settings, it is likely that work enclosure 112 will be sterilized between uses or top closure 148 with nozzle 144 and the female portion of quick-disconnect assembly (160) will be sterilized and the lower work enclosure (here, sidewall 136 and bottom closure 140) disposable. In the home setting there are several features that facilitate disassembly and cleaning, including: 1) readily removable bottom and top closures 140, 148 (FIG. 1); 2) smooth interior to sidewall 136 that contains few, to no, reentrant corners and other contaminant-trapping structures; 3) simply shaped sidewall that allows easy access to all internal surfaces of the sidewall by, for example, a bottle brush and 4) simply shaped internally facing surfaces of the bottom and top closures.

Regarding materials of construction of the various components of work enclosure 112, each of the components may be made of any material(s) suitable for that component. For example, sidewall 136 may be made of metal, plastic or composite, or any combination thereof, as may be bottom and top closures 140, 148. Likewise, nozzle 144 may be made of metal, plastic or composite, or any combination thereof. Considerations for selecting materials include strength, weight, durability and cost, among others.

Referring again to FIG. 1, in this example hand-washing system 100 includes a quick-disconnect assembly 160 and a shutoff valve 164 that provide the system with great flexibility. The combination of these two elements allows work enclosure 112 to be quickly and easily coupled to and decoupled from flexible conduit 116 for any of a variety of reasons without having to change the setting on mixing/flow valve 108. For example, if hand-washing system 100 includes a second work enclosure, such as child-sized work enclosure 168 (whereas work enclosure 112 is an adult-sized work enclosure), a user could readily switch between the differing work enclosures. In this example, it is noted that work enclosure 168 has all of the features of work enclosure 112, but is sized for smaller hands, such as hands of young children.

Quick-disconnect assembly 160 can be any suitable quick-disconnect assembly, such as a quick-disconnect assembly that includes a suitable combination of male and female couplings, for example, the male and female quick-disconnect couplings available from McMaster-Carr, Atlanta, Ga. Those skilled in the art will readily appreciate that the variety of quick-disconnect couplings is large and the choice of these couplings will depend on things such as the configuration of nozzle 144 (e.g., interiorly, exteriorly threaded, barbed, etc.), the configuration of the immediately adjacent upstream component (here, shutoff valve 164) (e.g., interiorly, exteriorly threaded, barbed, etc.) and design choice.

Similarly, shutoff valve 164 can be any suitable shutoff valve, such as a simple ball valve or stop cock. In other, more elaborate embodiments, the shutoff valve (if provided) can be a lever-type valve of the type commonly found on commercial kitchen utility spray assemblies adjacent the spray heads. An example of such a spray valve having a lever-type valve is the FIS-2946 spray valve available from Fisher Manufacturing Company, Tulare, Calif. It is noted that shutoff valve 164 need not be provided. In such embodiments, if having a water shutoff feature independent of mixing/flow valve 108 is desired, for example, for swapping work enclosures 112, 168 with one another, a type of quick-disconnect valve that shuts off flow when the male and female components are disconnected from one another may be used.

Figure 5:
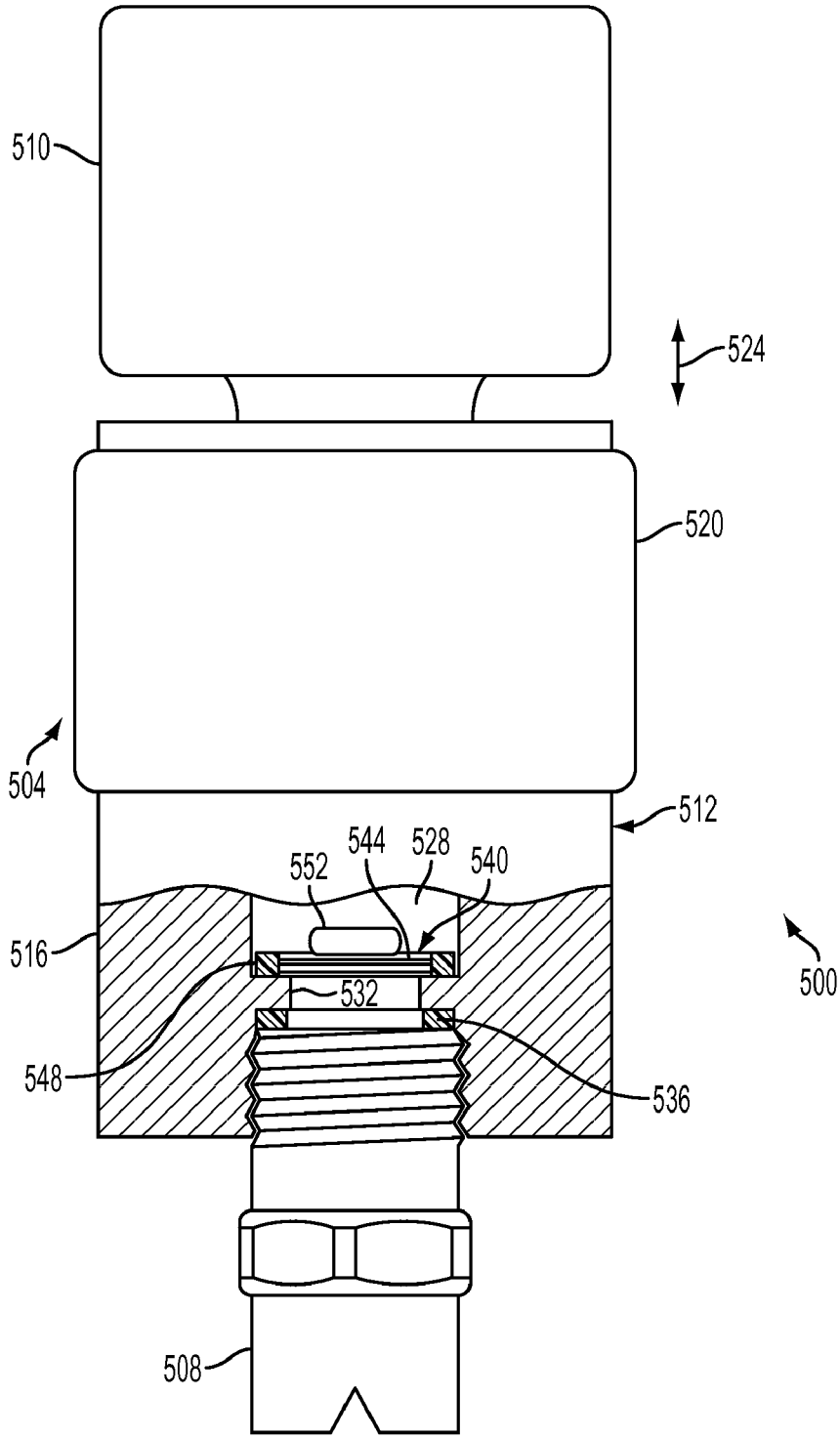
FIG. 5 is an enlarged partial cross-sectional view/partial elevational view of a quick-disconnect coupler/nozzle assembly configured to receive a pill for dispensing a washing agent to a work enclosure of a water-powered hand washer, such as either of the work enclosures of FIG. 1, when the assembly is coupled to such an enclosure.

FIG. 5 illustrates a particular quick-disconnect assembly/nozzle arrangement 500 that can be used with a work-enclosure made in accordance with the broad concepts described above, such as either of work enclosures 112, 168 of FIG. 1. Quick-disconnect assembly/nozzle arrangement 500 allows a user to enhance the cleaning performance of a hand-washing system of the present invention by dispensing a washing agent (e.g., soap, detergent, sanitizer, etc., and any combination thereof) into the water flow that reaches the user's digit(s) present in the work enclosure (not shown). In this example, quick-disconnect assembly/nozzle arrangement 500 comprises a quick-disconnect assembly 504 and a spray nozzle 508. Quick-disconnect assembly 504 includes a male coupling 510 and a female coupling 512 that removably engage one another in a conventional manner. In this example, female coupling 512 includes a body 516 and a sleeve 520 that is movable longitudinally relative to the body. When a user desires to uncouple male and female couplings 508, 512 from one another, the user moves sleeve 520 in the appropriate direction so as to initiate the disengaging process. Arrows 524 indicate the directions of movement of male coupling 510 during engagement and disengagement of the male coupling relative to female coupling 512 (assuming female coupling is fixed in space). Alternatively, some designs permit uncoupling to be initiated by a convenient button on the side of the female component. The Standard Push-Button Socket model no. 5163T11, available from McMaster-Carr, displays this feature.

In this example, body 516 of female coupling 512 includes a longitudinal central passageway 528 and an integral annular stop 532. Stop 532 provides a first shoulder for engaging a sealing gasket 536 between female coupling 516 and spray nozzle 508 and a second shoulder for engaging a screen assembly 540. Here, screen assembly 540 includes a screen 544 and an annular resilient gasket 548 that has a slight interference fit with passageway 528 so as to hold the assembly in place within the passageway. In this example, the washing-agent dispensing feature is implemented by a user inserting a washing-agent pellet or pill 552 into passageway 528 upstream of screen assembly 540. It is noted that the word "pill" is used herein and in the appended claims for convenience to denote both a self-contained mass of one or more pure washing agents and a self-contained mass of one or more pure washing agents in combination with one or more fillers, one or more binding agents, one or more additives, and/or a containment structure (e.g., a gel capsule), and any combination thereof. Pill 552 should have an appropriate shape that does not significantly impact the flow rate through female coupling 516.

In a typical scenario, a user inserts washing-agent pill 552 into passageway 528 by disengaging male coupling 510 from female coupling 512, places the pill into the passageway and re-engages the male coupling with the female coupling. During operation of the hand-washing system of which quick-disconnect assembly/nozzle arrangement 500 is made a part, water (not shown) flowing through passageway 528 slowly dissolves washing-agent pill 552 and causes the output (not shown) of spray nozzle 508 to contain the dissolved portion of the pill. In one embodiment, pill 552 is designed to dissolve in an amount of time equal to, or roughly equal to, the amount of time anticipated for a typical wash cycle, either for one hand or both hands, as desired. Other types of washing-agent dispensing arrangements are possible, such as an arrangement that uses a venturi eductor to draw a washing agent into the water flow before it is ejected into the work enclosure. Those skilled in the art will understand how to provide such alternative washing-agent dispensing arrangements to a hand-washing system made in accordance with the present disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of washing digits of a human hand, each digit having a nail bed, comprising:

providing a work enclosure having an opening, an interior space, a base portion with a bottom and a spray nozzle positioned opposite the bottom for providing a spray of water to the interior space that accumulates in the base portion so as to form a water reservoir with a water surface, the spray of water having a spray pattern with a central axis;

providing water to the spray nozzle inserting through the opening and into the interior space in the work enclosure at least one of the three-phalanx digits and opposing thumb;

delivering the spray of water toward the water surface while positioning the at least one of the three-phalanx digits and opposing thumb so that the spray of water penetrates into the nail beds of the digits and thumb for a first period of time and so that the central axis extends substantially perpendicular to the water surface; and allowing the water to accumulate in the base portion of the enclosure to a first depth and then flow out of the opening so as to maintain the first depth, the first depth selected so as to preclude water from the spray nozzle from parting water in the water reservoir deeply enough to reach the bottom of the base portion.

2. The method according to claim 1, further comprising, prior to said providing of the water, disconnecting said work enclosure from a water source using a quick-disconnect assembly, inserting a washing-agent pill into a quick-disconnect coupling of said quick-disconnect assembly, and reconnecting said work enclosure to a water source using said quick-disconnect assembly.

3. The method according to claim 1, further comprising, prior to said providing of the water, replacing a second work enclosure with said work enclosure using quick-disconnect couplings.

4. The method according to claim 1, further comprising during said inserting step, inserting the four three-phalanx digits through the opening at the same time.

5. The method according to claim 1, further wherein said inserting step is performed so that tips of the distal phalanges of at least one of the three-phalanx digits and opposing thumb are spaced no more than two inches from the spray nozzle.

6. The method according to claim 1, further wherein said inserting step is performed so that the tip of the distal phalanx of the thumb is spaced no more than two inches from the spray nozzle.

7. The method according to claim 1, wherein said inserting step is performed so that the at least one of the three-phalanx digits and opposing thumb are inserted in an upwardly curled position.

8. The method according to claim 1, wherein said first period of time is equal to at least 20 seconds.

9. The method according to claim 1, wherein no disinfectant chemicals are added to the water provided to the spray nozzle.

10. The method according to claim 1, wherein the water is provided so that the inlet water pressure of the spray nozzle is at least 30 pounds per square inch.

11. The method according to claim 1, further including moving slightly the at least one of the three-phalanx digits and opposing thumb while delivering the spray of water so as to enhance alignment of the nail beds of the digits and opposing thumb with the spray of water so as to facilitate penetration of the water into the nail beds.

12. A method according to claim 1, wherein said providing step includes providing water to the spray nozzle so that the inlet water pressure of the spray nozzle is at least 10 pounds per square inch, the outlet flow rate is at least 0.7 gallons per minute and the nozzle exit velocity of the spray of water delivered from the spray nozzle is at least 35 feet per second.

* * * * *